US009321096B2

(12) United States Patent
Agarwal

(10) Patent No.: US 9,321,096 B2
(45) Date of Patent: Apr. 26, 2016

(54) MOISTURE RESISTANT ELECTRICAL FITTINGS

(71) Applicant: Sage Metals Ltd., Delhi (IN)

(72) Inventor: V. K. Agarwal, Delhi (IN)

(73) Assignee: Sage Metals Ltd., Delhi (IN)

( * ) Notice: Subject to any disclaimer, the term of this patent is extended or adjusted under 35 U.S.C. 154(b) by 58 days.

(21) Appl. No.: 14/198,118

(22) Filed: Mar. 5, 2014

(65) Prior Publication Data

US 2015/0255891 A1 Sep. 10, 2015

(51) Int. Cl.

| | |
|---|---|
| ***H01R 4/60*** | (2006.01) |
| ***B21D 51/16*** | (2006.01) |
| ***B21D 22/14*** | (2006.01) |
| ***B21D 53/36*** | (2006.01) |

(52) U.S. Cl.

CPC ..... *B21D 51/16* (2013.01); *B21D 22/14* (2013.01); *B21D 53/36* (2013.01)

(58) Field of Classification Search

CPC ..... H01R 4/60
USPC ..... 235/462.44; 439/282, 333, 346, 562, 439/271

See application file for complete search history.

(56) References Cited

U.S. PATENT DOCUMENTS

| | | | | |
|---|---|---|---|---|
| 5,888,083 | A | 3/1999 | Seilhan et al. | |
| 6,737,584 | B2 | 5/2004 | Kiely | |
| 7,080,859 | B1 | 7/2006 | Gretz et al. | |
| 7,229,325 | B1 | 6/2007 | Flynn et al. | |
| 7,350,832 | B1 | 4/2008 | Kiely | |
| 7,374,212 | B1 | 5/2008 | Gretz | |
| 7,438,327 | B2 | 10/2008 | Auray et al. | |
| 7,563,100 | B1 | 7/2009 | Smith | |
| 7,883,338 | B2 | 2/2011 | Smith | |
| 8,038,462 | B2 | 10/2011 | Svelnis et al. | |
| 8,129,633 | B1 | 3/2012 | Shemtov | |
| 8,449,317 | B1 | 5/2013 | Dang | |
| 2011/0271518 | A1 | 11/2011 | Metzger | |
| 2012/0088385 | A1* | 4/2012 | Marklove et al. | 439/271 |
| 2012/0252282 | A1* | 10/2012 | Maki | 439/784 |
| 2013/0244485 | A1* | 9/2013 | Lam et al. | 439/580 |
| 2014/0134871 | A1* | 5/2014 | Jozwik et al. | 439/350 |
| 2014/0187965 | A1* | 7/2014 | Reiter | 600/467 |

* cited by examiner

*Primary Examiner* — Allyson Trail
(74) *Attorney, Agent, or Firm* — Roger D. Emerson; Emerson Thomson Bennett, LLC

(57) ABSTRACT

Disclosed is an electrical fitting which includes a cylindrical and hollow body of substantially constant thickness extending along a central axis with an interior and an exterior; a first opening with an inner perimeter defined at a first end portion of the body along the central axis; and, a second opening with an inner perimeter defined at a second end portion of the body opposite the first end portion. The first and second end portions of the body of the electrical fitting are spaced from a central portion of the body and have a substantially constant axial thickness. At least one of the first and second end portions of the electrical fitting has an expanded portion relative to the central portion of the body. Further disclosed are methods for forming the electrical fitting.

21 Claims, 8 Drawing Sheets

(SECTION AA' OF FIG. 7)

(SECTION AA' OF FIG 9)

MOISTURE RESISTANT ELECTRICAL FITTINGS

TECHNICAL FIELD

Provided is an electrical fitting for protecting conduits, electrical boxes and electrical pathways from the deleterious effects of moisture and other environmental conditions while also offering secure engagement between connecting conduits and electrical boxes.

BACKGROUND

Electrical fittings are used to connect conduits (raceway), electrical boxes and electrical pathways (e.g., electrical wiring and electrical circuits). Conduits may be made from metal (e.g., electrical metallic tubing or EMT). In application, electrical fittings provide two basic functions—the first of which is to ensure the continuous raceway for wires through the connecting conduits and the second of which is to provide a structure which isolates and protects the wire raceway within the conduit from the external environment. With regard to the first function, the electrical fitting may be designed to have a structural integrity which ensures the connecting conduits remain engaged to the fitting under various conditions of stress. With regard to the second function, fittings may be designed to ensure that the wire running within the conduits through the fitting are not exposed to elements of the external environment (e.g., condensation) and that the material flowing within the conduit does not exit the flow system into to the external environment. Accordingly, the present disclosure provides an electrical fitting which can ensure that the connecting conduits, electrical boxes and electrical pathways remain engaged under various conditions of stress and a continuous flow of electrical current. The present disclosure also provides an electrical fitting which can protect the connecting circuit or electrical pathway from various elements of the external environment including but not limited to rain, moisture, vapor, liquids and water.

SUMMARY

An electrical connector is provided which includes a cylindrical and hollow body of substantially constant thickness extending along a central axis with an interior and an exterior; a first opening with an inner perimeter defined at a first end portion of the body along the central axis; and a second opening with an inner perimeter defined at a second end portion of the body opposite the first end; wherein the first and second end portions of the body are spaced from a central portion of the body, have a substantially constant axial thickness and wherein at least one of the first and second end portions has an expanded portion relative to the central portion of the body.

An electrical coupling is provided which includes a cylindrical and hollow body of substantially constant thickness extending along a central axis with an interior and an exterior; a first opening with an inner perimeter defined at a first end portion of the body along the central axis; a second opening with an inner perimeter defined at a second end portion of the body opposite the first end; wherein the first and second ends of the body are spaced from a central portion of the body, have a substantially constant axial thickness and wherein at least one of the first and second end portions has an expanded portion relative to the central portion of the body.

A method for forming an electrical connector is provided which includes the steps of forming a cylindrical and hollow body of substantially constant thickness extending along a central axis with an interior and an exterior, a first opening with an inner perimeter defined at a first end portion of the body along the central axis and a second opening with an inner perimeter defined at a second end portion of the body opposite the first end; spinning the body to form a necked-down portion having a substantially constant axial thickness, and spaced from the second opening, wherein the necked-down portion includes a first round being concave relative to the interior of the body and a second round extending from the first round and being convex relative to the interior of the body, the rounds being directly adjacent to one another along the central axis; and threading external threads at the first and second end portions of the body.

A method for forming an electrical coupling is provided which includes the steps of forming a cylindrical and hollow body of substantially constant thickness extending along a central axis, having an interior and an exterior, a first opening with an inner perimeter defined at a first end portion of the body along the central axis, a second opening with an inner perimeter defined at a second end portion of the body opposite the first end; spinning the body to form two expanded portions defined by the body, having a substantially constant axial thickness, and spaced from a central portion of the body at the first and second end portions of the body respectively; spinning the body to form a round at the central portion of the body being concave relative to the interior of the body; and threading external threads at the first and second end portions of the body.

DESCRIPTION

Figure 1:
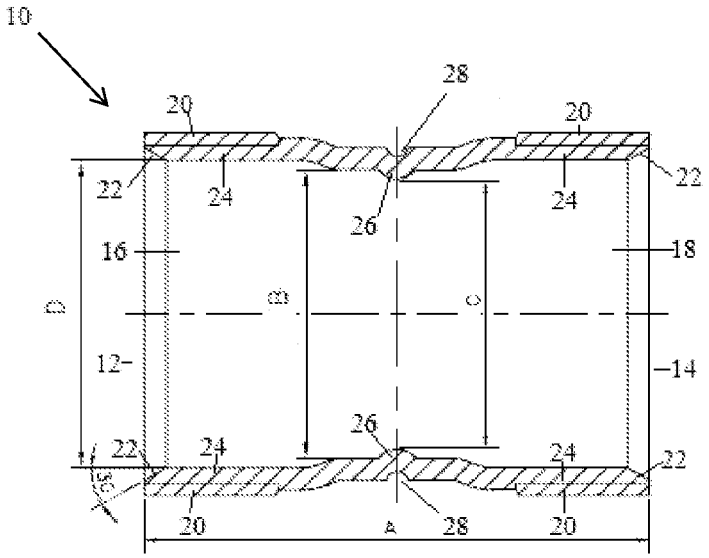
FIG. 1 illustrates a cross-sectional view of an exemplary electrical coupling body.

An electrical fitting is provided which is capable of engaging conduits (raceway), electrical boxes and electrical pathways. The electrical fitting may, in certain embodiments, be moisture resistant. Conduits include any type of tubing system which is used for housing and protecting electrical pathways, such as a wire, cable or fiber optic wave guide. Conduits may be made of any metals. Metal conduits include rigid metal conduit (RMC), galvanized rigid conduit (GRC), intermediate metal conduit (IMC), electrical metallic tubing (EMT), aluminum conduit, stainless steel conduit, bronze conduit and brass conduit. In certain embodiments disclosed herein, the metal conduits employed with the electrical fitting are electrical metallic tubing (EMT).

Non-limiting examples of electrical fittings include compression couplings and compression connectors. Compression couplings are used to connect two pieces of conduit (which may be of the same or different type) together. Compression connectors are used to connect conduit to an electrical box. In one embodiment, the electrical fitting may be an electrical coupling. In other embodiments, the electrical fitting may be an electrical connector. In certain embodiments, the electrical coupling may be an EMT coupling and may include compression and non-compression couplings. In other embodiments, the electrical connector may be an EMT connector and may include compression and non-compression connectors.

In one embodiment, the electrical fitting is in the shape of a cylindrical and hollow body with an interior and an exterior and includes a first end portion and a second end portion opposite one another. The first end portion defines a first opening having an inner perimeter and the second end portion defines a second opening having an inner perimeter within the electrical fitting. The first opening and/or the second opening may be capable of receiving conduits and/or engaging an electrical box.

The cylindrical and hollow body may define a chamber for conduits when passed through the first and/or second opening of the body. In some embodiments, the cylindrical hollow body defines a compression chamber for conduits. The cylindrical and hollow body of the electrical fitting may be of substantially constant thickness, constant thickness or varying thickness. The cylindrical and hollow body may extend along a central axis or a non-central axis; may extend along straight or a curved axis and may have either a symmetrical or asymmetrical shape about the axis.

The first end portion and/or second end portion of the electrical fitting may include a fastening means which is capable of engaging a connecting piece to the first end portion and/or the second end portion. In certain embodiments, the fastening means may terminate in a box (e.g., an electrical box) with a lock nut. The fastening means may include but are not limited to any of the following: clamps, clips, flanges, snap fasteners, threaded fasteners, pins, etc. In certain embodiments, the fastening means employed are threaded fasteners. In embodiments utilizing threaded fasteners, external threads may be located on the first end portion and/or the second end portion of the electrical fitting. In certain embodiments, threaded fasteners are located on both the first and second end portions of the body of the electrical fitting. The external threads are capable of engaging connecting pieces which are internally threaded. In certain embodiments, the connecting piece is an internally threaded nut. The internally threaded nut may include at least one compression nut and/or at least one lock nut and may engage either the first and/or second end portions of the cylindrical hollow body. In certain embodiments, the electrical fitting is an electrical connector which engages a conduit (e.g., EMT) on one side and an electrical box on the other side. In one embodiment, the electrical connector has a compression nut which engages the external threads of a first end portion of the electrical connector to engage a conduit and a lock nut which engages the external threads of a second end portion of the electrical connector to engage an electrical box. In another embodiment, the electrical fitting is an electrical coupling which engages two connecting pieces which include two internally threaded compression nuts. The compression nuts are capable of allowing conduit (e.g., EMT) to pass through into the interior of the electrical coupling or compression chamber when partially engaged to the first and second end portion of the electrical coupling.

In certain embodiments of the electrical connector, the cylindrical and hollow body may define at least one necked-down portion. The necked-down portion may have a substantially constant axial thickness, a constant axial thickness or a varying axial thickness. In certain embodiments, the necked-down portion has a substantially constant axial thickness. The necked-down portion may be spaced from the first and/or the second opening or end portion of the cylindrical hollow body. The necked-down portion may include at least one round which may be either convex or concave relative to the interior of the cylindrical hollow body and may be positioned at any point along the cylindrical hollow body. In certain embodiments, the necked-down portion is spaced from the first opening of the cylindrical hollow body and includes a first round which is concave relative to the interior of the cylindrical hollow body and a second round which is convex relative to the interior of the cylindrical hollow body. In further embodiments, the second round extends from the first round. The rounds may be directly adjacent to one another or spaced apart along the central axis of the cylindrical hollow body. The rounds may serve as a stop point for engaging conduit within the electrical connector and/or may facilitate the compression of the electrical connector around the conduit. In one embodiment, the rounds are directly adjacent to one another along the central axis of the cylindrical hollow body.

In one embodiment, the necked-down portion of the electrical connector is defined by the body having an expanded portion at the end of the body opposing the end portion of the body which includes the necked-down portion. By "expanded" it is meant that the diameter of the expanded first and/or second opening of the body of the electrical fitting is increased relative to either the diameter of the opening on the opposing end portion of the body, the diameter of an interior cross-sectional area within the central portion of the body or the diameter of any other cross-sectional area within the interior of the body. The expanded portion may have a substantially constant axial thickness, a constant axial thickness or a varying axial thickness. In certain embodiments, the expanded portion has a substantially constant axial thickness. In certain embodiments, the first end portion of the body of the electrical connector comprises an expanded portion relative to that of the second end portion of the body which comprises a necked-down portion.

In an exemplary embodiment, the electrical fitting is an electrical coupling which comprises a body having first and second end portions wherein at least one of the first and second end portions have an expanded portion relative to a central portion of the body. In certain embodiments, the electrical coupling has two expanded portions at the first and second end portions of the body. The two expanded portions may be spaced from a central portion of the body, may be expanded relative to the central portion of the body and may have a substantially constant axial thickness. By "expanded" it is meant that the diameter of the expanded first and/or second opening of the body of the electrical fitting is increased relative to either the diameter of the opening on the opposing end portion of the body, the diameter of an interior cross-sectional area within the central portion of the body or the diameter of any other cross-sectional area within the interior of the body. In certain embodiments, the first and second end portions of the body of the electrical coupling are expanded relative to the central portion of the body.

Necked-down portions, necked-down portions having rounds which may be convex or concave relative to the interior of the cylindrical hollow body, expanded portions, and the cylindrical hollow body in general may be formed by metal forming techniques (e.g., metal forming).

The electrical fitting may include at least one seat that can be positioned at any point along the exterior of the cylindrical hollow body. In certain embodiments, the electrical fitting is an electrical connector which includes a seat that is positioned adjacent to the lock nut on the cylindrical hollow body. The seat is capable of holding an o-ring for sealing the box surface after fastening the lock nut in place. The seat may or may not be positioned adjacent to or over a round defined in the body of the electrical connector. In certain embodiments of the electrical connector, the seat is situated between the lock nut and the second round which is convex relative to the interior of the cylindrical hollow body. In certain embodiments, the seat is formed from a round which is concave relative to the interior of the cylindrical body. In further embodiments, this cylindrical hollow body defines a first round which is concave relative to the interior of the cylindrical hollow body, a second round extending from the first round which is convex relative to the interior of the cylindrical hollow body and directly adjacent to the first round and a third round which is concave relative to the interior of the cylindrical hollow body and situated between the second round and the lock nut. In certain embodiments, this third round defines a seat for an o-ring. Other seats may be positioned at any point along the cylindrical hollow body of the electrical fitting.

As mentioned above, at least one compression nut may engage external threads at either the first and/or second end portion of the cylindrical hollow body of the electrical fitting. The compression nut includes an internal compression chamber which houses a compression device. In certain embodiments, the compression nut includes an interior having a top end and a bottom end. In an exemplary embodiment, the compression device housed within the compression chamber of the compression nut is a washer spring (compression ring). In certain embodiments, the washer spring is helical in that it includes at least two filaments wrapped at least once around each other in a spiral-like manner. As the compression nut is tightened upon the external threads of the first and/or second end portion of the cylindrical hollow body, the washer spring (compression ring) will be caused to compress and expand radially outward.

The first and/or second opening of the cylindrical hollow body of the electrical fitting may have a peripheral edge which circumferentially extends around the inner perimeter of the first and/or second opening. The peripheral edge may serve as a seat upon which a washer spring (compression ring) of a compression nut may rest. In certain embodiments, the peripheral edge is positioned on the first end portion of the cylindrical hollow body of the electrical fitting, which in certain embodiments may be an electrical connector. In other embodiments the peripheral edge is positioned on the first and second end portions of the cylindrical hollow body of the electrical fitting, which in certain embodiments may be an electrical coupling.

The first and/or second end portion of the cylindrical hollow body may include a sealing ring and the first and/or second end portion of the cylindrical hollow body of the electrical fitting may include a seat which circumferentially extends around an inner perimeter of the first and/or second end portion of the body for housing the sealing ring. The seat for the sealing ring may be formed by expanding a portion of the first and/or second end portion of the body relative to the central portion, necked-down portion or opposing end (the first or second end) of the body. In certain embodiments of the electrical connector, the seat for the sealing ring on the first end portion of the cylindrical hollow body is expanded relative to the second end portion of the body (the body being of substantially constant thickness) which includes a necked-down portion. In certain embodiments of the electrical coupling, the sealing ring is housed within the first and second end portions of the cylindrical hollow body, both of which are expanded relative to the central portion of the cylindrical hollow body (the body being of substantially constant thickness).

The sealing ring may be formed into any shape which is capable of providing a protective seal against the external environment. In certain embodiments, the sealing ring has a beveled end cap which may rest upon or engage a portion of the first and/or second end portion of the body referred to as the inner periphery. The inner periphery portion of the first and/or second end portion may be beveled to form a portion of the seal ring seat. In certain embodiments the inner periphery is beveled at an angle ranging from about 20 degrees to about 40 degrees relative to the pre-beveled edge of the inner periphery. In certain embodiments, the inner periphery of the first and/or second end portion is beveled at an angle of about 30 degrees relative to the pre-beveled edge of the inner periphery.

In embodiments where the electrical fitting which comprises an electrical connector which includes a lock nut and a compression nut, tightening the compression nut upon the external threads of the first end portion causes the inner diameter and inner perimeter of the first opening which houses the sealing ring (compression ring) at the first end portion to collapse or cave in (i.e., diminish) to engage and seal a connecting conduit. Tightening the lock nut and adjacent o-ring upon the external threads of the second end portion causes the second end portion to engage and seal the electrical connector against the box surface.

Rounds defined in the body of the electrical fitting may act as a conduit stop point, may assist in the compression of the electrical fitting around the connecting conduits to secure them in place and may also assist in the collapse of the diameter and inner perimeter of the first and/or second end portions or opening of the body upon tightening the engaged nut. In certain embodiments of the electrical connector, the second round convex relative to the interior of the cylindrical hollow body may, in certain embodiments, define a bulge within the necked-down portion. In certain embodiments, this bulge may have an inner diameter and inner perimeter that is greater than the inner diameter and inner perimeter of the first and/or second opening of the body. In certain embodiments, the bulge may have an inner diameter and inner perimeter that is greater than the inner diameter and inner perimeter of the expanded portion positioned at the first or second opening or end portions of the body.

In embodiments where the electrical fitting comprises an electrical coupling which includes two compression nuts, tightening the compression nuts upon the external threads of the first and second end portions causes the inner diameter or inner perimeter of the sealing ring (compression ring) on the first and second end portions to collapse or cave in (i.e., diminish) to engage and seal connecting conduits at the first and second end portions of the body.

As mentioned above, in certain embodiments, the electrical fitting may be an EMT electrical connector or an EMT electrical coupling. The cylindrical hollow body of an EMT electrical fitting may be made from any metallic materials. In certain embodiments, the cylindrical hollow body may be made from steel. In further embodiments, the cylindrical hollow body may be made from zinc plated steel pipe.

Materials which may be used to manufacture the washer spring (compression ring) include but are not limited to CRC steel sheet.

The seal ring may be made from a polymer. In certain embodiments, the seal ring is made from a thermoplastic polymer. In further embodiments, the thermoplastic polymer used to manufacture the seal ring include but are not limited to polycarbonate, polypropylene and combinations thereof.

Materials which may be used to manufacture the o-ring include rubber. In certain embodiments, materials which may be used to manufacture the o-ring include neoprene rubber.

The compression nut may be made from any metallic materials. In certain embodiments, materials which may be used to manufacture the compression nut include steel.

The components of the electrical fitting provide a protective seal for conduit(s), electrical pathways and electrical boxes from the external environment. The seal the electrical fitting provides includes protection from moisture and condensation resulting in a moisture resistant electrical fitting.

A method for forming an electrical fitting is also provided. The method of forming the electrical fitting includes the step of forming a cylindrical and hollow body. In an exemplary embodiment, the cylindrical hollow body is shaped into a form of substantially constant thickness extending along a central axis, having an interior and an exterior, a first opening with an inner perimeter defined at a first end portion of the body along the central axis and a second opening defined at a second end portion of the body opposite the first end. The method of forming the electrical fitting also includes the steps of spinning and forming the cylindrical hollow body.

In embodiments where the electrical fitting is an electrical connector and where the cylindrical hollow body is constructed from metal, metal spinning techniques are used to form a necked-down portion defined by the body. In certain embodiments, the method of forming the electrical connector may include the steps of spinning and forming the cylindrical and hollow body to form a necked-down portion at the first or second end portion of the electrical connector and/or an expanded portion at the first or second end portion of the electrical connector. In certain embodiments, the end of the body opposite the necked-down portion may be expanded relative to the necked-down portion. The expanded portion may be spun and formed into a shape having a substantially constant axial thickness. In certain embodiments, the electrical connector is formed by shaping the expanded portion at the first end portion of the body into a form of substantially constant axial thickness and shaping a necked-down portion at the second end portion of the body to include a first round being concave relative to the interior of the body and a second round extending from the first round and being convex relative to the interior of the body, with the rounds being directly adjacent to one another along a central axis. The method of forming the electrical connector may also include the step of spinning and forming the cylindrical and hollow body to form a third round being concave relative to the interior of the body, wherein an exterior of the third round forms a seat onto which an o-ring is seated around the cylindrical and hollow body between the lock nut and the second round of the body.

The method of forming the electrical fitting also includes the step of threading external threads at the first and second end portions of the cylindrical hollow body.

In embodiments where the electrical fitting is an electrical coupling, the method of forming the electrical coupling may include the step of spinning and forming the cylindrical hollow body to encompass a shape which includes two expanded portions respectively positioned within the area defined at the first and second end portions relative to a central portion of the body. The two expanded portions, defined by the body, may have a substantially constant axial thickness, and may be spaced from a central portion of the body at the first and second ends of the body respectively.

A method of using an electrical connector is also provided. The method includes the step of engaging a first conduit with a first opening at a first end portion of a cylindrical and hollow body with an interior and an exterior, the first end portion of the body having external threads and a partially engaged compression nut. The method also includes the step of engaging a second end portion of the body with an electrical box, the second end portion of the cylindrical and hollow body having external threads and a partially engaged lock nut. The cylindrical hollow body used in the method may be of a substantially constant thickness, may extend along a central axis and may include a necked-down portion defined by the body. The electrical connector may also include an expanded portion at the first end portion of the body relative to the second end portion of the body which includes a necked-down portion. In certain embodiments, the necked-down portion may be of a substantially constant axial thickness, spaced from the second opening, include a first round being concave relative to an interior of the body, a second round extending from the first round and being convex relative to an interior of the body, and the rounds may be directly adjacent to one another along the central axis. The method also includes the step of passing an electrical pathway from the electrical box through the second end portion of the electrical connector, the body of the electrical connector and first end portion of the electrical connector to the conduit engaged with the first end portion of the electrical connector. The compression nut on the first end portion and the lock nut on the second end portion of the cylindrical and hollow body (or vice versa) can then be tightened to fasten the conduit to the first end portion and the second end portion to the box.

A method of using an electrical coupling is also provided. The method comprises engaging a first conduit with a first opening at a first end portion of a cylindrical and hollow body with an interior and an exterior and a second conduit into a second opening at a second end portion opposite the first end portion of the cylindrical and hollow body. The body may be of substantially constant thickness extending along a central axis. The first and second end portion may have external threads and a partially engaged compression nut. The body may include two expanded portions (defined by the body) which have a substantially constant axial thickness and are spaced from a central portion of the body at the first and second end portion of the body respectively. The expanded portions at the first and second end portion may both be expanded relative to the central portion of the body. The method also includes the step of passing an electrical pathway through the conduit engaged with the first end portion of the electrical coupling, the body of the electrical coupling and the conduit engaged with the second end portion of the electrical coupling. The method also includes the step of tightening the compression nuts on the first and second end portions of the cylindrical and hollow body to fasten the first conduit and second conduit to the electrical coupling.

FIG. 1 illustrates a cross-sectional view of an exemplary electrical coupling 10 in the design of a compression coupling having a cylindrical hollow body. The electrical coupling 10 includes a first end portion 12, a second end portion 14, a first opening 16 and a second opening 18. Surrounding the outer circumference of the first end portion 12 and second end portion 14 of the cylindrical hollow body of the electrical coupling 10 are external threads 20 which may be threaded to suit a nut and which may be threaded according to Unified Thread Standard specifications or the National Standard for Free-Fitting Straight Mechanical Pipe. The electrical coupling 10 includes a first round 26 and a second round 28 which are concave relative to the interior of the electrical coupling. The electrical coupling 10 also includes an expanded portion 24, relative to the length denoted in reference point (B), on the first end portion 12 and second end portion 14. The inner periphery 22 of the first end portion 12 and second end portion 14 of the electrical coupling 10 are beveled at an angle of about 30 degrees to form a portion of the seal ring seat. Reference point (A) denotes the length of the cylindrical hollow body of the electrical coupling 10. Reference point (C) denotes the diameter of the interior of the electrical coupling 10 between the first round 26. Reference point (D) denotes the diameter of the first opening 16 and the second opening 18 of the electrical coupling 10. Table I provided below includes the dimensions for a variety of differently sized exemplary electrical couplings.

TABLE I

| Compression Coupling Size (inch) | A ± 2.0 (mm) | B (mm) | C (mm) | D (mm) |
|---|---|---|---|---|
| ½ | 31.0 | 18.4 ± 0.3 | 17.0 ± 0.7 | 19.6 ± 0.3 |
| ¾ | 33.0 | 23.9 ± 0.3 | 22.2 ± 1.0 | 25.1 ± 0.3 |
| 1 | 40.0 | 30.0 ± 0.3 | 28.3 ± 1.0 | 31.2 ± 0.3 |
| 1¼ | 43.0 | 39.0 ± 0.3 | 37.1 ± 1.0 | 40.2 ± 0.3 |
| 1½ | 45.0 | 45.0 ± 0.5 | 43.0 ± 1.0 | 46.2 ± 0.5 |
| 2 | 47.0 | 56.5 ± 0.5 | 54.6 ± 1.0 | 57.7 ± 0.5 |

Figure 2:
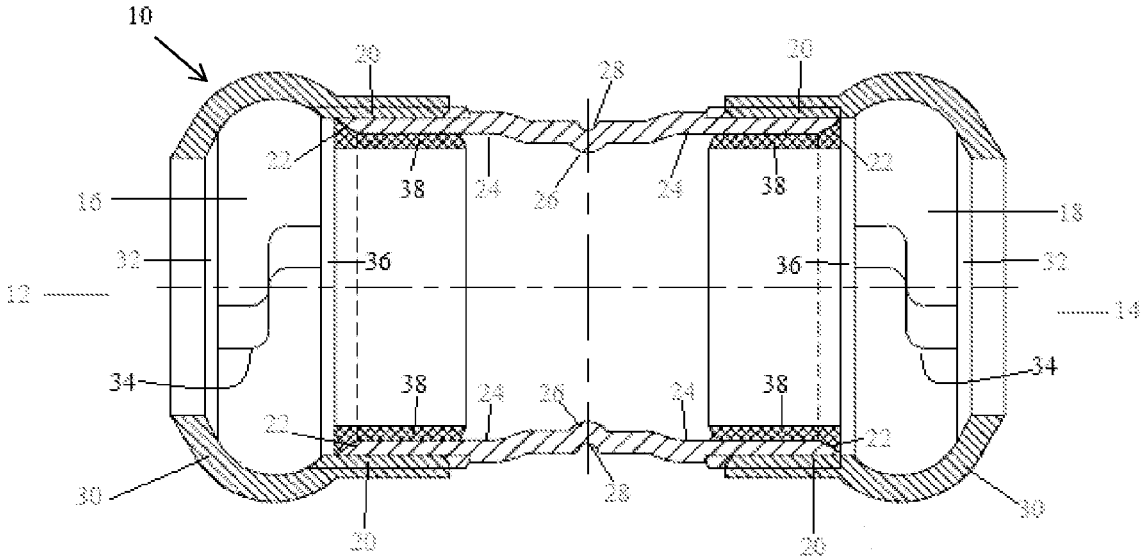
FIG. 2 illustrates a cross-sectional view of an exemplary electrical coupling assembly.

FIG. 2 illustrates a cross-sectional view of an exemplary electrical coupling in the design of a compression coupling having two compression connector nuts 30 engaged to external threads 20 on the first end portion 12 and second end portion 14 of the electrical coupling 10. The compression connector nuts 30 includes an internal compression chamber having a top end 32 and a bottom end 36 which houses a washer spring 34. The washer spring 34 sets upon a peripheral edge 36 which circumferentially extends around the inner perimeter of the first opening 16 and the second opening 18 of the electrical coupling 10. A seal ring 38 is set on the inner periphery 22 of the first end portion 12 and the second end portion 14 of the electrical coupling 10 and circumferentially extends around the expanded portion 24 of the electrical coupling 10. The electrical coupling 10 includes a first round 26 and a second round 28 which are concave relative to the interior of the electrical coupling 10.

Figure 3:
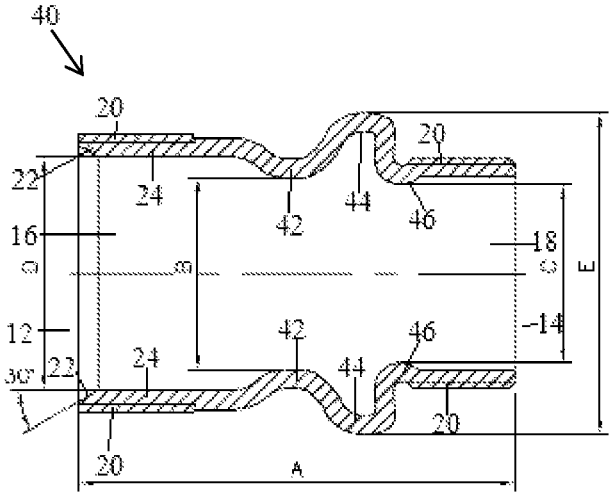
FIG. 3 illustrates a cross-sectional view of an exemplary electrical connector.

FIG. 3 illustrates a cross-sectional view of an exemplary electrical connector 40 in the design of a compression connector having a cylindrical hollow body. The electrical connector 40 includes a first end portion 12, a second end portion 14, a first opening 16 and a second opening 18. Surrounding the outer circumference of the first end portion 12 and second end portion 14 of the cylindrical hollow body of the electrical connector 40 are external threads 20 which are threaded to suit a nut. The threads on at least one of the first and/or second end portion of the body may be threaded according to Unified Thread Standard specifications or the National Standard for Free-Fitting Straight Mechanical Pipe. The electrical connector 40 includes a first round 42 which is concave relative to the interior of the electrical connector 40, a second round 44 which is convex relative to the interior of the electrical connector 40 and a third round 46 which is concave relative to the interior of the electrical connector 40. The electrical connector 40 also includes an expanded portion 24, relative to the diameter denoted in reference points (B) and (C). The diameter of the expanded portion 24 is denoted by reference point (D). The inner periphery 22 of the first end portion 12 of the electrical connector 40 is beveled at an angle of about 30 degrees to form a portion of the seal ring seat. Reference point (A) denotes the length of the electrical connector 40. Reference point (C) denotes the diameter between the third round 46 within the interior of the cylindrical hollow body of the electrical connector 40. Reference point (E) denotes the diameter between the exterior edges of the second round 44 of the electrical connector 40 which bulges out beyond the diameter of the expanded portion 24. Table II provided below includes the dimensions for a variety of differently sized exemplary electrical connectors.

TABLE II

| Compression Connector Size (inch) | A ± 2.0 (mm) | B (mm) | C (mm) | D (mm) | E ± 1.5 |
|---|---|---|---|---|---|
| ½ | 32.0 | 18.4 ± 0.3 | 15.0 ± 0.8 | 19.6 ± 0.3 | 26.0 |
| ¾ | 36.0 | 23.9 ± 0.3 | 20.2 ± 1.0 | 25.1 ± 0.3 | 32.5 |
| 1 | 41.0 | 30.0 ± 0.3 | 26.2 ± 1.0 | 31.2 ± 0.3 | 40.0 |
| 1¼ | 47.0 | 39.0 ± 0.3 | 34.5 ± 1.0 | 40.2 ± 0.3 | 50.0 |
| 1½ | 55.0 | 45.0 ± 0.5 | 40.5 ± 1.0 | 46.2 ± 0.5 | 55.0 |
| 2 | 64.0 | 56.5 ± 0.5 | 51.5 ± 1.0 | 57.7 ± 0.5 | 67.0 |

Figure 4:
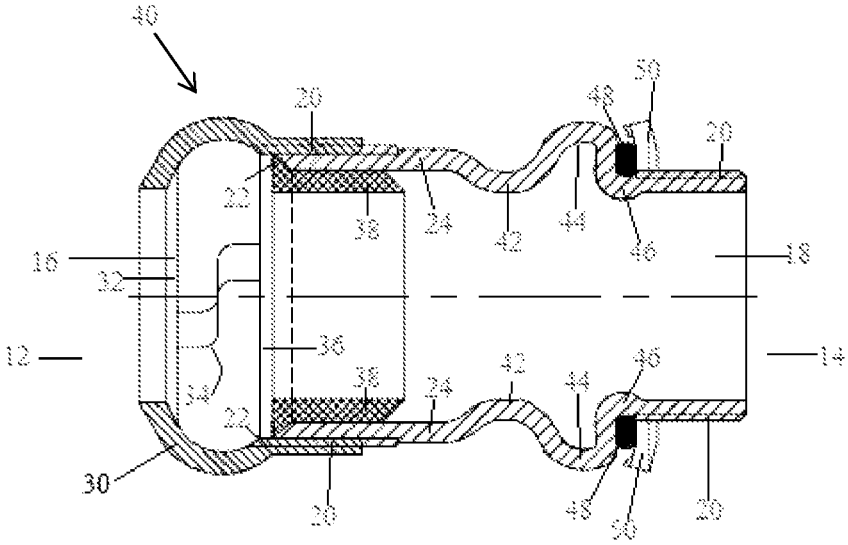
FIG. 4 illustrates a cross-sectional view of an exemplary electrical connector assembly.

FIG. 4 illustrates a cross-sectional view of an exemplary electrical connector 40 in the design of a compression connector with a compression connector nut 30 and a lock nut 50 on opposite ends. The electrical connector 40 includes a first end portion 12, a second end portion 14, a first opening 16 and a second opening 18. Surrounding the outer circumference of the first end portion 12 and second end portion 14 of the cylindrical hollow body of the electrical connector 40 are external threads 20. The electrical connector 40 includes a first round 42 which is concave relative to the interior of the electrical connector 40, a second round 44 which is convex relative to the interior of the electrical connector 40 and a third round 46 which is concave relative to the interior of the electrical connector 40. The electrical connector 40 also includes an expanded portion 24, relative to the diameter and perimeter of the interior of the second end portion 14 of the cylindrical hollow body of the electrical connector 40 which includes the necked-down portion. A compression connector nut 30 engages the first end portion 12 of the electrical connector 40. The compression connector nut 30 includes an internal compression chamber having a top end 32 and a bottom end 36 which houses a washer spring 34. The washer spring 34 sets upon a peripheral edge 36 which circumferentially extends around the inner perimeter of the first opening 16 of the electrical connector 40. A seal ring 38 is set on the inner periphery 22 of the first end portion 12 of the electrical connector 40 and circumferentially extends around the expanded portion 24 of the electrical connector 40. The third round 46 forms a seat on the exterior of the cylindrical hollow body of the electrical connector 40 upon which an o-ring 48 is seated. A lock nut 50 threaded on the external threads 20 on the second end portion 14 of the electrical connector 40 is engaged adjacent to the o-ring 48.

Figure 5:
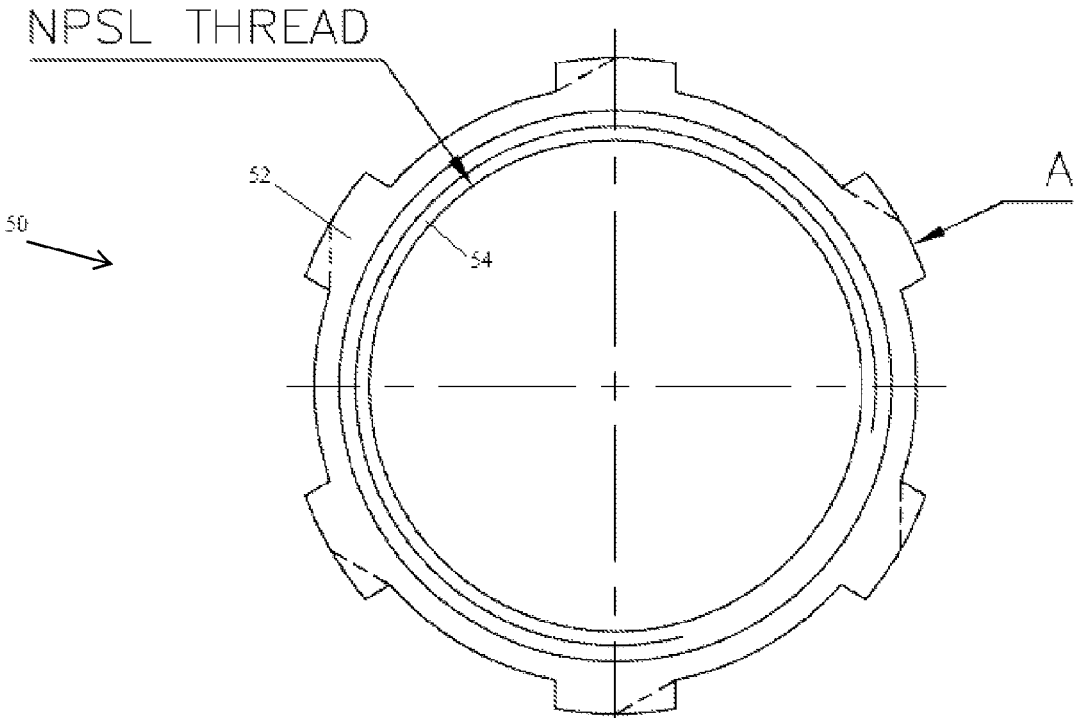
FIG. 5 illustrates plan view of an exemplary lock nut.
Figure 6:
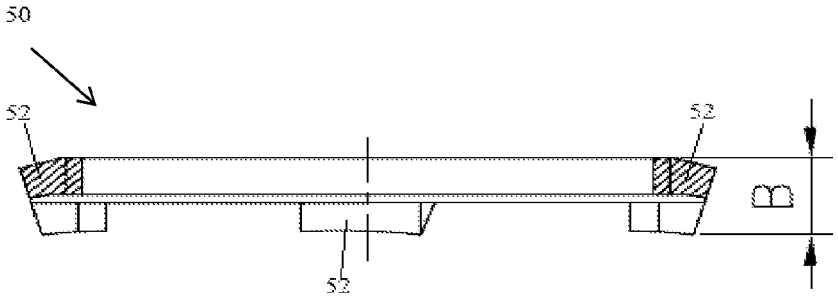
FIG. 6 illustrates a side view of the exemplary lock nut of FIG. 5.

FIG. 5 illustrates a plan view of an exemplary lock nut 50 having castellated edges 52. NPSL (American Standard Straight Locknut Pipe Thread) thread 54 encircles the circumference of the interior of the lock nut 50. Reference (A) denotes the length of the castellated edge 52 of the lock nut 50. FIG. 6 illustrates a side view of the exemplary lock nut 50 of FIG. 5. Reference (B) denotes the height of the lock nut 50 between opposing castellated edges 52 of the lock nut 50. Table III provided below includes the dimensions for a variety of differently sized exemplary lock nuts.

TABLE III

| Compression Connector Size (inch) | A ± 2.0 | B (mm) ± 0.5 |
|---|---|---|
| ½ | 29.0 | 5.0 |
| ¾ | 35.5 | 5.0 |
| 1 | 44.0 | 6.0 |
| 1¼ | 53.5 | 6.5 |
| 1½ | 61.0 | 6.5 |
| 2 | 74.0 | 6.5 |

Figure 7:
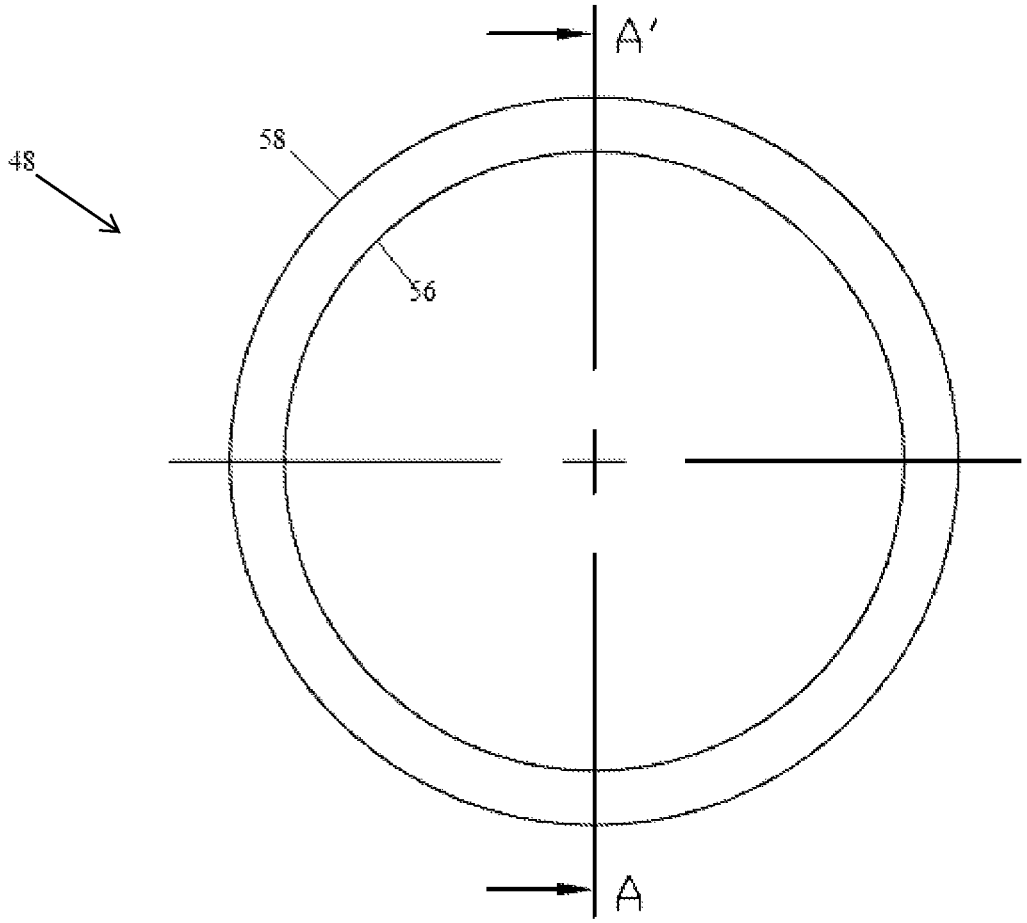
FIG. 7 illustrates a plan view of an exemplary o-ring.
Figure 8:
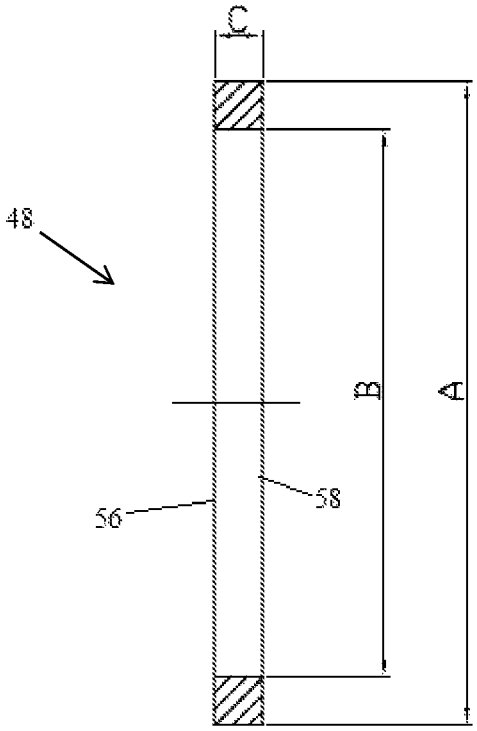
FIG. 8 illustrates a sectional view of the exemplary o-ring of FIG. 7 taken along section AA'.

FIG. 7 illustrates a plan view of an exemplary o-ring 48 including interior edge 56, exterior edge 58 and reference points (A) and (A'). FIG. 8 illustrates a sectional view of the exemplary o-ring 48 of FIG. 7 taken along section AA'. Reference (A) denotes the circumference of the exterior edge 58 of the o-ring 48. Reference (B) denotes the circumference of the interior edge 56 of the o-ring 48. Reference (C) denotes the width of the o-ring. Table IV provided below includes the dimensions for a variety of differently sized exemplary o-rings.

TABLE IV

| Compression Connector Size (inch) | A (mm) | B (mm) | C ± 0.1 (mm) |
|---|---|---|---|
| ½ | 25.0 | 19.5 | 2.75 |
| ¾ | 32.0 | 26.0 | 3.25 |
| 1 | 38.5 | 32.0 | 3.35 |
| 1¼ | 48.0 | 40.0 | 4.25 |
| 1½ | 55.0 | 47.0 | 4.75 |
| 2 | 67.0 | 58.5 | 4.75 |

Figure 9:
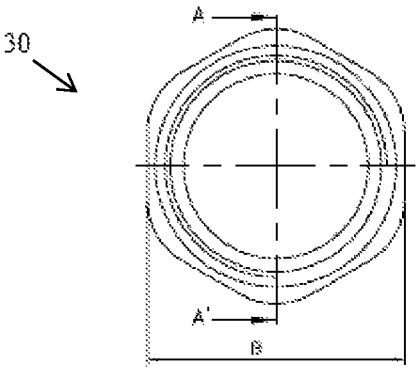
FIG. 9 illustrates a plan view of an exemplary compression connector nut.
Figure 10:
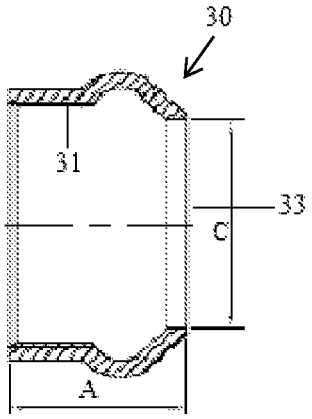
FIG. 10 illustrates a cross-sectional view of the exemplary compression connector nut of FIG. 9.

FIG. 9 illustrates a plan view of an exemplary compression connector nut 30 with reference points (A), (A') and (B). Reference point (B) denotes the width of the compression connector nut 30. FIG. 10 illustrates a cross-sectional view of the exemplary compression connector nut 30 of FIG. 9 (section AA') with reference points (A) and (C). Reference point (A) denotes the length of the compression connector nut 30. The compression connector nut 30 includes internal threads 31 which are threaded to suit the external threads 20 of the cylindrical hollow body of the electrical connector 40 and/or electrical coupling 10. Reference point (C) denotes the diameter of the interior end 33 of the compression connector nut 30 on the side opposite the cylindrical hollow body when engaged to the electrical connector 40 or the electrical coupling 10. Table V provided below includes the dimensions for a variety of differently sized exemplary compression nuts.

TABLE V

| Compression Coupling/ Connector Size (inch) | A (mm) | B (mm) | C ± 0.1 (mm) |
|---|---|---|---|
| ½ | 25.0 | 19.5 | 2.75 |
| ¾ | 32.0 | 26.0 | 3.25 |
| 1 | 38.5 | 32.0 | 3.35 |
| 1¼ | 48.0 | 40.0 | 4.25 |

TABLE V-continued

| Compression Coupling/ Connector Size (inch) | A (mm) | B (mm) | C ± 0.1 (mm) |
|---|---|---|---|
| 1½ | 55.0 | 47.0 | 4.75 |
| 2 | 67.0 | 58.5 | 4.75 |

Figure 11:
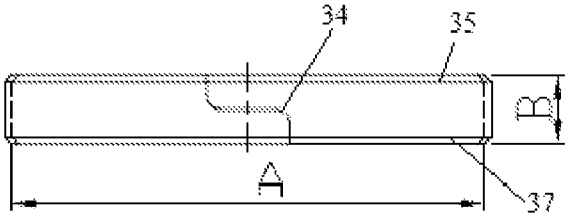
FIG. 11 illustrates a plan view of an exemplary washer spring also known as a compression ring.

FIG. 11 is a sectional view of the exemplary washer spring (compression ring) 34 including a top end plate 35 and a bottom end plate 37. Reference point (A) denotes the length of the top end plate 35 and the bottom end plate 37. Reference point (B) denotes the height of the washer spring (compression ring) in closed condition. Table VI provided below includes the dimensions for a variety of differently sized exemplary washer springs (compression rings).

TABLE VI

| Compression Coupling/ Connector Size (inch) | A (mm) | B (mm) | C ± 0.1 (mm) |
|---|---|---|---|
| ½ | 25.0 | 19.5 | 2.75 |
| ¾ | 32.0 | 26.0 | 3.25 |
| 1 | 38.5 | 32.0 | 3.35 |
| 1¼ | 48.0 | 40.0 | 4.25 |
| 1½ | 55.0 | 47.0 | 4.75 |
| 2 | 67.0 | 58.5 | 4.75 |

Figure 12:
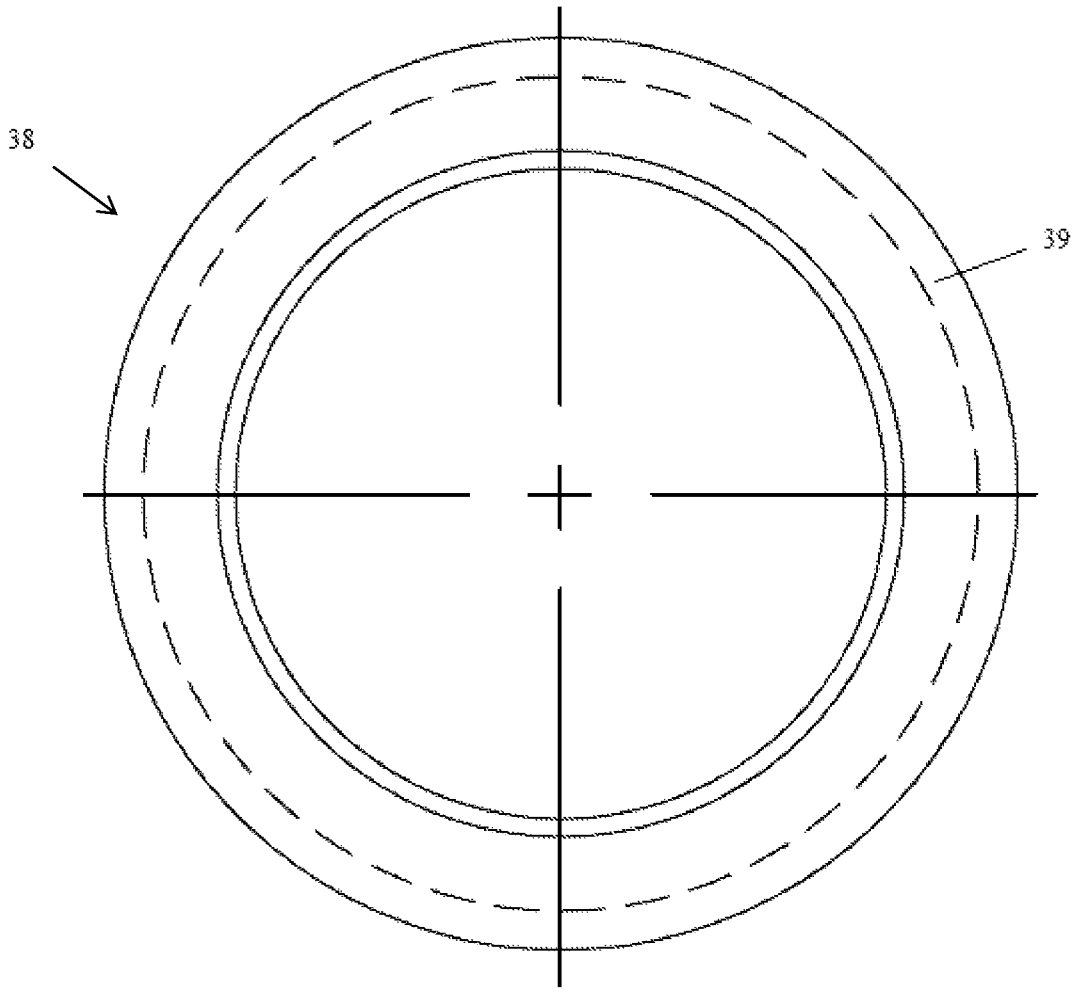
FIG. 12 illustrates a plan view of an exemplary sealing ring.
Figure 13:
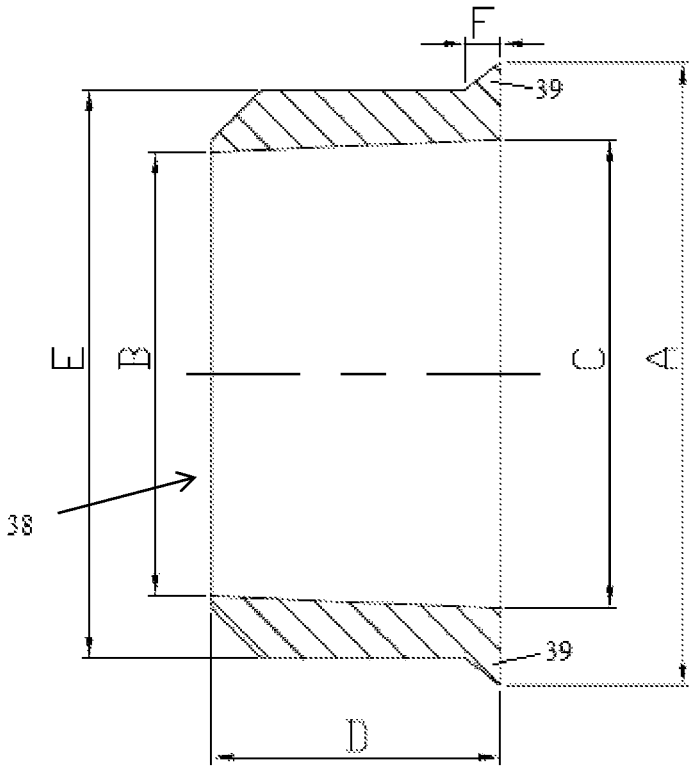
FIG. 13 illustrates a sectional view of the exemplary sealing ring of FIG. 12.

FIG. 12 illustrates a plan view of an exemplary sealing ring 38 having an end cap 39. FIG. 13 illustrates a cross-sectional view of the exemplary sealing ring 38 of FIG. 12. Reference point (A) denotes the diameter between the outer edges of the sealing ring 38 as it rests on the beveled edges of the sealing ring seat (not shown). Reference point (B) denotes the diameter between the inner edges of the sealing ring 38 housed within the interior of the cylindrical hollow body of the electrical connector 40 or electrical coupling 10. Reference point (C) denotes the diameter between the inner edges of the sealing ring 38 set around the first and/or second opening 16 and 18 of the electrical connector 40 or electrical coupling 10. Reference point (D) denotes the length of the sealing ring 38 set within the body of the electrical connector 40 or electrical coupling 10. Reference point (E) denotes the diameter between the outer edges of the sealing ring 38 set within the interior of the cylindrical hollow body of the electrical connector 40 or electrical coupling 10. Reference point (F) denotes the length of the end cap 39 of the sealing ring 38. Table VII provided below includes the dimensions for a variety of differently sized exemplary sealing rings.

TABLE VII

| Compression Coupling/ Connector Size (inch) | A (mm) | B (mm) | C ± 0.1 (mm) |
|---|---|---|---|
| ½ | 25.0 | 19.5 | 2.75 |
| ¾ | 32.0 | 26.0 | 3.25 |
| 1 | 38.5 | 32.0 | 3.35 |
| 1¼ | 48.0 | 40.0 | 4.25 |
| 1½ | 55.0 | 47.0 | 4.75 |
| 2 | 67.0 | 58.5 | 4.75 |

While the electrical fitting has been described above in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the electrical fitting should not be limited to any single embodiment, but rather construed in breadth and scope in accordance with the recitations of the appended claims.

What is claimed is:

1. An electrical connector comprising:

a cylindrical and hollow body of substantially constant thickness extending along a central axis with an interior and an exterior;

a first opening with an inner perimeter defined at a first end portion of the body along the central axis; and, a second opening with an inner perimeter defined at a second end portion of the body opposite the first end; and a necked-down portion defined by the body, having a substantially constant axial thickness, and spaced from the first or second opening, wherein the necked-down portion includes a first round being concave relative to the interior of the body and a second round extending from the first round and being convex relative to the interior of the body, the rounds being directly adjacent to one another along the central axis;

wherein the first and second end portions of the body are spaced from a central portion of the body, have a substantially constant axial thickness and wherein at least one of the first and second end portions has an expanded portion relative to the central portion of the body.

2. The electrical connector of claim 1, wherein the necked-down portion comprises a third round extending from the second round and being concave relative to the interior of the body, wherein the third round forms a seat around the exterior of the body.

3. The electrical connector of claim 2, wherein the first end portion and second end portion of the body comprise external threads and wherein a compression nut, which is internally threaded, engages the external threads of the first end portion; a lock nut, which is internally threaded, engages the external threads of the second end portion; and an o-ring rests on the seat formed by the third round on the exterior of the body between the lock nut and the second round of the body.

4. The electrical connector of claim 3, wherein the compression nut comprises an interior having a top end and a bottom end which houses a washer spring, wherein the first opening of the body comprises a peripheral edge which circumferentially extends around the inner perimeter of the first opening and wherein the peripheral edge of the first opening forms a seat upon which the bottom end of the compression nut sets upon tightening the compression nut upon the first end portion of the body.

5. The electrical connector of claim 4, wherein the first end portion of the body comprises a seat which circumferentially extends around the inner perimeter of the first end portion for housing a sealing ring.

6. The electrical connector of claim 5, wherein the first end portion of the body comprises the expanded portion relative to that of the second end portion of the body which comprises the necked-down portion.

7. The electrical connector of claim 6, wherein the seat for housing the sealing ring is within the expanded portion at the first end portion of the body.

8. The electrical connector of claim 7, wherein the sealing ring has a beveled end cap which engages an inner periphery portion of the first end portion of the body, wherein the inner periphery portion is beveled to form a portion of the seal ring seat.

9. The electrical connector of claim 8, wherein tightening the compression nut upon the first end portion causes the inner perimeter of the first opening of the body to collapse and tightening the lock nut upon the second end portion engages the second end portion of the body to an electrical box.

10. An electrical coupling comprising:

a cylindrical and hollow body of substantially constant thickness extending along a central axis with an interior and an exterior;

a first opening with an inner perimeter defined at a first end portion of the body along the central axis; and, a second opening with an inner perimeter defined at a second end portion of the body opposite the first end portion;

wherein the first and second end portions of the body are spaced from a central portion of the body, have a substantially constant axial thickness and wherein the first and second end portions have an expanded portion relative to the central portion of the body; and, wherein the first and second end portions of the body comprise external threads allowing two internally threaded compression nuts to respectively engage the external threads of the first and second end portions of the body.

11. The electrical coupling of claim 10, wherein the compression nuts comprise an interior having a top end and a bottom end which houses a washer spring, wherein the first and second openings of the body comprises a peripheral edge which circumferentially extends around the inner perimeter of the first and second openings and wherein the peripheral edge of the first and second openings form a seat upon which the bottom end of the compression nuts respectively set upon tightening the respective compression nuts upon the first and second end portions of the body.

12. The electrical coupling of claim 11, wherein the first and second end portions of the body respectively comprise a seat which circumferentially extends around the inner perimeter of the first and second end portions for housing a sealing ring.

13. The electrical coupling of claim 12, wherein the first and second end portions of the body have an expanded portion relative to the central portion of the body.

14. The electrical coupling of claim 13, wherein the seat for housing the sealing ring at the first and second end portions of the body is within the expanded portion at the first and second end portions of the body respectively.

15. The electrical coupling of claim 14, wherein the sealing ring has a beveled end cap which engages an inner periphery portion of the first and second end portions of the body respectively, wherein the inner periphery portion is beveled to form a portion of the seal ring seat.

16. The electrical coupling of claim 15, wherein the central portion of the body comprises a round being concave relative to the interior of the body.

17. The electrical coupling of claim 16, wherein tightening the compression nuts upon the first and second end portions causes the inner perimeter of the first and second opening of the body to collapse.

18. A method for forming an electrical connector comprising the steps of:

forming a cylindrical and hollow body of substantially constant thickness extending along a central axis with an interior and an exterior, a first opening with an inner perimeter defined at a first end portion of the body along the central axis and a second opening with an inner perimeter defined at a second end portion of the body opposite the first end, wherein the first and second end portions of the body are spaced from a central portion of the body, have a substantially constant axial thickness and wherein at least one of the first and second end portions has an expanded portion relative to the central portion of the body;

spinning the body to form a necked-down portion having a substantially constant axial thickness, and spaced from the first opening, wherein the necked-down portion includes a first round being concave relative to the interior of the body and a second round extending from the first round and being convex relative to the interior of the body, the rounds being directly adjacent to one another along the central axis; and threading external threads at the first and second end portions of the body.

19. The method of claim 18 further comprising the step of spinning the body to form a third round being concave relative to the interior of the body, wherein the third round forms a seat onto which an o-ring is seated around the exterior of the body, wherein the third round lies between a lock nut engaged to the second end portions of the body and the second round of the body.

20. The method of claim 19, further comprising the step of spinning the body to form an expanded portion at the first end portion of the body.

21. A method for forming an electrical coupling comprising the steps of:

forming a cylindrical and hollow body of substantially constant thickness extending along a central axis, having an interior and an exterior, a first opening with an inner perimeter defined at a first end portion of the body along the central axis, a second opening with an inner perimeter defined at a second end portion of the body opposite the first end;

spinning the body to form two expanded portions defined by the body, having a substantially constant axial thickness, and spaced from a central portion of the body at the first and second end portions of the body respectively;

spinning the body to form a round at the central portion of the body being convex relative to the interior of the body; and threading external threads at the first and second end portions of the body.

* * * * *